United States Patent [19]

Takemoto

[11] Patent Number: 4,569,607

[45] Date of Patent: Feb. 11, 1986

[54] PRINTING HAMMER REBOUND CONTROL

[75] Inventor: Takeshi Takemoto, Yamato, Japan

[73] Assignee: Ricoh Company, Ltd., Japan

[21] Appl. No.: 603,980

[22] Filed: Apr. 25, 1984

Related U.S. Application Data

[63] Continuation of Ser. No. 333,790, Dec. 23, 1981, abandoned.

[30] Foreign Application Priority Data

Dec. 27, 1980 [JP] Japan ..... 55-188421

[51] Int. Cl.[4] ..... B41J 9/42; B41J 7/94

[52] U.S. Cl. ..... 400/167; 400/166; 400/157.3; 101/93.02; 101/93.03

[58] Field of Search ..... 400/167, 166, 157.3; 101/93.02, 93.03, 93.48

[56] References Cited

U.S. PATENT DOCUMENTS

| | | | |
|---|---|---|---|
| 3,172,353 | 3/1965 | Helms | 101/93.03 |
| 3,678,847 | 7/1972 | Pear, Jr. et al. | 101/93.02 |
| 3,741,113 | 6/1973 | Mako et al. | 101/93.02 |
| 4,062,285 | 12/1977 | Deetz et al. | 101/93.02 |
| 4,103,617 | 8/1978 | O'Brien et al. | 101/93.03 |
| 4,239,401 | 12/1980 | Veale | 101/93.02 |
| 4,291,992 | 9/1981 | Barr et al. | 400/167 |
| 4,353,656 | 10/1982 | Sohl et al. | 400/157.3 |

FOREIGN PATENT DOCUMENTS

| | | | |
|---|---|---|---|
| 2360323 | 7/1974 | Fed. Rep. of Germany | 101/93.03 |

OTHER PUBLICATIONS

A. B. Habich; "Print Hammer Rebound Control"; *IBM Technical Disclosure Bulletin;* vol. 22, No. 10, p. 4348; Mar. 1980.

IBM Technical Disclosure Bulletin; "Dual Coil Print Hammer"; Lee et al., vol. 22, No. 12, May 1980, p. 5398.

*Primary Examiner*—Edgar S. Burr
*Assistant Examiner*—David A. Wiecking
*Attorney, Agent, or Firm*—Guy W. Shoup

[57] ABSTRACT

A printing hammer rebound control system for use in impact-type printing machines is provided. The present system includes separate memory devices for storing the information of primary and its associated secondary energization. The primary energization is to move the printing hammer in the printing direction and the secondary energization is to slow down the hammer when it is in the returning motion. The present system applies an appropriate secondary energization in accordance with the intensity of the primary energization applied, thereby allowing to maintain the level of hammer rebound and production of noise at a minimum.

18 Claims, 10 Drawing Figures

PRINTING HAMMER REBOUND CONTROL

This is a continuation of application Ser. No. 333,790, filed Dec. 23, 1981, now abandoned.

BACKGROUND OF THE INVENTION

1. Field of the Invention

This invention relates to improvements in impact-type printing machines and more in particular to a printing hammer rebound control for insuring a smooth returning motion of the hammer irrespective of the condition of its forward or impacting motion.

2. Description of the Prior Art

Shown in FIG. 1 is a plunger type printing hammer assembly which is widely used. The assembly comprises a coil 1 supported by a yoke 2, which also supports a pair of bearings 3 and 4. A printing hammer 5 is rotatably and slidably supported by the bearings 3 and 4. The hammer 5 comprises sliding shaft sections 9 and a core section 10, which is generally located inside the coil 1, and an impact surface 5' is formed at its forward end. As shown, the core section 10 is formed somewhat larger in diameter than the sliding shaft sections 9 to provide a shoulder portion, and a coil spring 6 is provided to extend between one end surface of the bearing 3 and the shoulder portion of the core section 10.

When the coil 1 is energized by passing a current therethrough, the hammer 5 is forced to move in the direction indicated by the arrow A and, therefore, the impact surface 5' comes into contact with a type element 7 located at a printing section to cause the type element 7 impact a recording medium (not shown) on a platen 8 thereby forming a printed character on the recording medium. Then, the coil 1 is deenergized with an appropriate timing so that the hammer 5 now moves in the direction indicated by the arrow B because it receives the repulsive force from the platen 8 at the time of impact as well as the recovery force of the spring 6.

However, when the backward shoulder of the core section 10 hits the bearing 4 at the extreme end of the returning motion of the hammer 5, the hammer 5 bounces back and force or vibrates. To cope with such a problem, it has been proposed to provide a damper 11 as shown in FIG. 1. It has, however, been found that such an approach is unsatisfactory for various reasons. For example, use may be made of a rubber damper with ease; however, the damping characteristics deteriorate as the rubber ages.

In the case where the impact energy of the returning hammer 5 is not sufficiently absorbed by the damper 11, the hammer 5 rebounds and moves again in the direction indicated by the arrow A. It may happen that the rebounding hammer 5 again strikes the type element 7, and, alternatively, the forward end of the hammer 5 may be trapped between spokes of the printing wheel which is in rotation to bring the next selected type element to the printing section. In the worst case, the printing wheel may be damaged, necessitating replacement with a new one.

It is true that a hammer rebound may be decreased by decelerating the returning velocity of the hammer 5 when it approaches its original position. Such deceleration may be carried out by reenergizing the coil 1. Such a rebound control concept is illustrated in FIGS. 2(*a*) and (*b*). As shown, when a main energization of the coil 1 is carried out by an electric current having waveform A shown in FIG. 2(*b*), the hammer 5 displaces as shown by the solid line in FIG. 2(*a*). At the tail end of the displacement curve, the amount of rebound is indicated by S. However, if the coil 1 is reenergized during the returning motion of the hammer 5 by an electric current having waveform B shown in FIG. 2(*b*), the hammer 5 is decelerated at its final step thereby decreasing the amount of rebound as shown by the dotted line in FIG. 2(*a*).

It should, however, be noted that different type characters require different impact forces in order to attain uniform print density along an entire line of different characters. Moreover, it is sometimes required to print some characters or words with a different print density from the other characters or words in order to highlight the informational context of the document being printed. One such typical prior art printing system which can provide a variable print hammer striking force capable of being adjusted over a wide range of magnitudes is disclosed in the U.S. Pat. No. 4,118,129, issued to Grundherr on Oct. 3, 1978. Under such conditions, the above-described rebound control approach required further refinement and improvements.

SUMMARY OF THE INVENTION

The present printing hammer rebound control system is directed for use in an impact type printing machine which includes a slidably supported hammer which has an impact surface for impacting a selected type element and a core section, a coil disposed in operative association with said core section, and biasing means for biasing said hammer in a predetermined direction. And, the present printing hammer rebound control system comprises storing means for storing primary energization information and secondary energization information, each of which is previously determined in association with each type element of the printing machine and energization control means for controlling the application of the primary and secondary energization information to said coil such that the primary energization information is supplied to the coil to move the hammer in the forward direction to impact the selected type element and the secondary energization information is supplied to the coil when the hammer is approaching its original position in its returning motion.

Preferably, the energization control means includes timing control means for controlling the timing of the secondary energization. In this case, the secondary energization information may be a constant value. The timing control means, preferably, includes a timer which is operated in association with the primary and secondary energization information. Such energization control means includes duration control means for controlling the duration of the secondary energization. In such a case, the timing of application of the secondary energization may be held constant. The duration control means, preferably, includes a timer which is operated in association with the primary and secondary energization information.

It is to be noted that, the storing means for storing primary and secondary energization information may preferably be comprised of a semiconductor memory device such as a read only memory, or ROM. Moreover, the energization control means may be comprised of a microprocessor.

It is therefore an object of the present invention to provide improvements in impact-type printing machines.

Another object of the present invention is to provide a printing hammer rebound control system for providing a smooth reciprocating motion of the printing hammer.

A further object of the present invention is to provide a printing hammer rebound control system capable of maintaining the level of hammer rebound at a minimum value even if the striking force of the printing hammer varies.

A still further object of the present invention is to provide a printing hammer rebound control system which is simple in structure and thus easy to manufacture.

A still further object of the present invention is to provide a printing hammer rebound control system which provides a prolonged service life and consistent performance.

Other objects, advantages and novel features of the present invention will become apparent from the following detailed description of the invention when considered in conjunction with the accompanying drawings.

DESCRIPTION OF THE PREFERRED EMBODIMENTS

Description will now be had as to embodiments of the present invention with particular reference to FIGS. 3 through 6.

Figure 1:
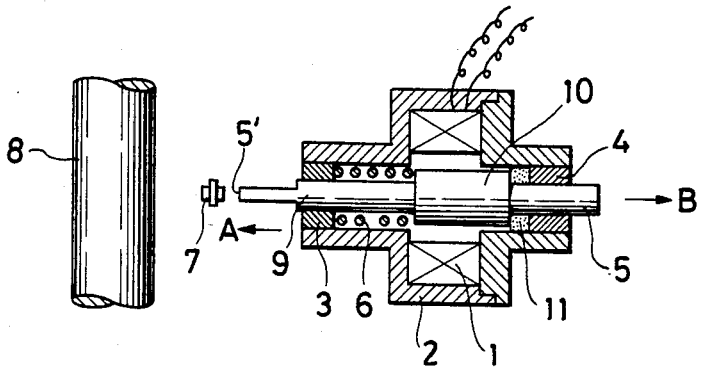
FIG. 1 PRIOR ART
FIG. 1 is a schematic illustration showing the structure of a typical plunger-type hammer to which the present invention may be applied.
Figure 2:
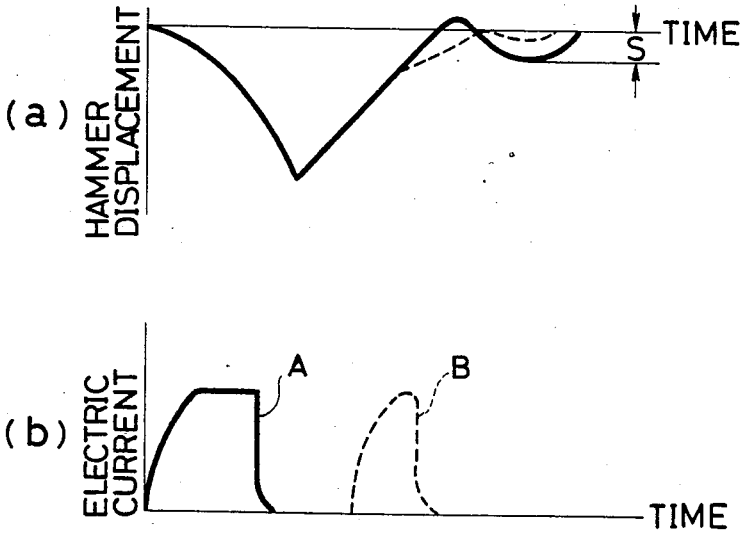
FIG. 2 PRIOR ART
FIGS. 2(*a*) and (*b*) are graphs in which FIG. 2(*a*) shows the displacement of the hammer as a function of time when current signal A of FIG. 2(*b*) is applied.
Figure 3:
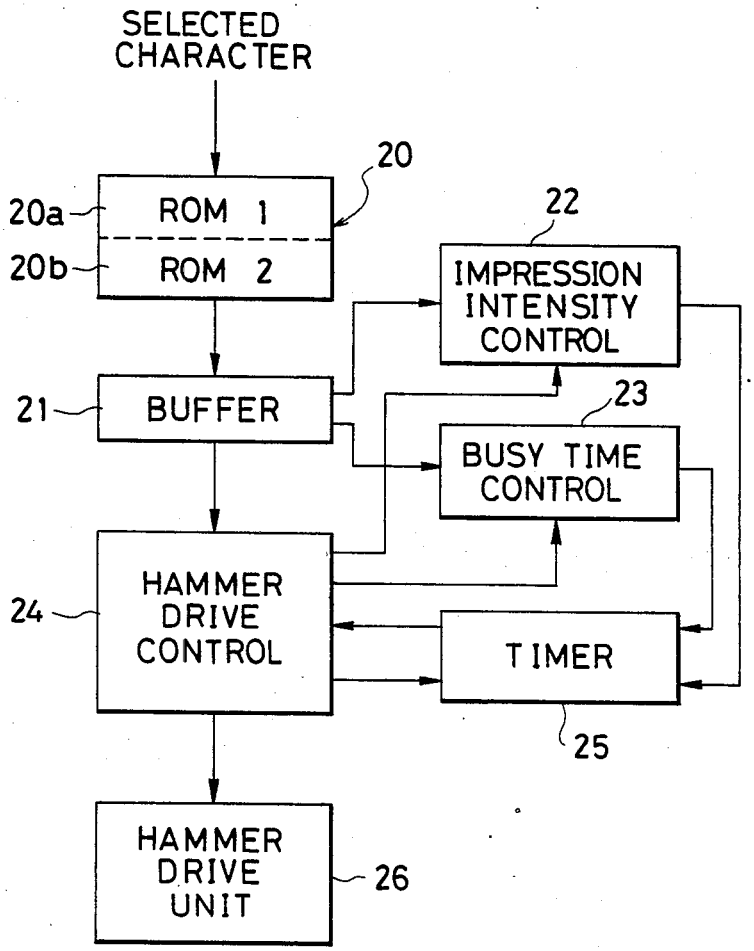
FIG. 3 is a block diagram showing the basic structure of the present invention.

As shown in FIG. 3, the printing hammer rebound control system includes a memory device 20 to which a selected character signal is applied from a character selector (not shown). As a feature of the present invention, the memory device 20 has two separate sections 20*a* and 20*b* each of which contains separate information for energizing a hammer drive unit 26 which corresponds to the coil 1 of FIG. 1. The first memory section 20*a* stores primary energization information which is to be applied to the coil 1 so as to cause the hammer 5 to move in the printing direction A. The first memory section 20*a* contains a plurality of primary energization data, each of which is previously determined in association with a particular type element. This is because, some type elements require larger impact forces than other type elements, as previously described. Typically, those primary energization data are comprised of codes indicating the width of a current pulse to be applied to the coil 1.

The second memory section 20*b* contains a plurality of secondary energization data, each of which may be previously determined in association with a particular type element, or, preferably, in association with the primary energization data. The secondary energization information is a retarding or decelerating signal which is to be applied to the coil 1 when the hammer 5 is approaching the original position in its returning motion.

It is important to note that the hammer 5 returns to the original position with a varying speed because the hammer strikes the type element 7 and the platen 8 with a differing speed depending upon the nature of the type element 7 to be impacted. Since the hammer 5 approaches its original position with a varying speed in accordance with the type element 7 selected, the manner of reenergization for decelerating the hammer 5 in motion must be suitably altered in order to keep the level of hammer rebound at a minimum at all times. Since the returning speed, particularly its approaching speed to the original position, is directly related to the level of the primary energization, an appropriate level of reenergization or secondary energization to be applied to the coil 1 for decelerating the hammer 5 in returning motion may be previously determined. The secondary energization data may be determined in any manner by those skilled in the art and those data are stored in the second memory section 20*b*.

It should be noted that the memory device 20 may be formed by a one-chip semiconductor memory such as a read only memory. Alternatively, each memory section 20*a* or 20*b* may be formed by a separate memory device.

As shown in FIG. 3, the memory device 20 is connected to a buffer 21, preferably comprised of a shift-register, which receives primary energization data and secondary energization data in association with a particular character selected for printing. The buffer 21 is connected to a primary energization control 22 and a secondary energization control 23, each of which is preferably comprised of a register. Each of the control units 22 and 23 is connected to a timer 25, which, in turn, is connected to a hammer drive control 24.

As shown, the hammer drive control 24 is also operatively associated with the buffer 21 and control units 22 and 23. The hammer drive control 24 may preferably be comprised of a microprocessor and, as will be described later, the control unit 24, upon receipt of an initiation signal from the buffer 21, sends out instructions to receive data for energizing the coil 1 under control.

In operation, when a selected character signal is applied to the memory device 20, primary and secondary energization data which are associated with the selected character are supplied to the buffer 21. Then, the buffer 21 supplies an initiation signal to the hammer drive control 24 and, at the same time, the buffer 21 supplies the primary energization data to the control unit 22 and the secondary energization data to the control unit 23. In turn, in response to an instruction supplied from the hammer drive control, the control unit 22 triggers the timer 25. Thus, the hammer drive control maintains the hammer drive unit 26 energized for a period of time determined by the primary energization data now contained in the control unit 22. Accordingly, the hammer 5 is forced to move in the printing direction A to carry out impact printing.

When the timer 25 times up, the hammer drive control 24 sends an instruction to the control unit 23 to retrigger the timer 25. In accordance with one embodiment of the present invention, the secondary energization information is comprised of data indicating the timing or initiation of application of the reenergization signal. In this case, use may be made of the same energization current pulse, and the information of such current pulse may be previously stored in the hammer drive control. Thus, when the timer 25 times up, the hammer drive control detects this condition and sends the reenergization signal to the hammer drive unit 26, or coil 1.

In accordance with another embodiment of the present invention, the secondary energization information is comprised of data indicating the intensity or pulse width of the reenergization current pulse to be applied to the coil 1. In this case, the timing of application of the reenergization signal may be held unchanged and such timing information may preferably be stored in the hammer drive control 24. In this case, the timer 25 starts its operation in accordance with a trigger signal supplied from the hammer drive control 24 after elapsing a predetermined time period. And, when the timer is triggered, the hammer drive control keeps the hammer drive unit 26 energized for a period of time determined by the data contained in the control unit 23.

Therefore, the hammer receives a suitable decelerating force depending on its returning speed at all times so that its rebound may be kept at a minimum level, or not at all in practical sense. It is to be noted that the above-described first and second embodiments may be combined to form a further embodiment which can naturally provide an enhanced performance as compared with the first two embodiments.

Figure 4:
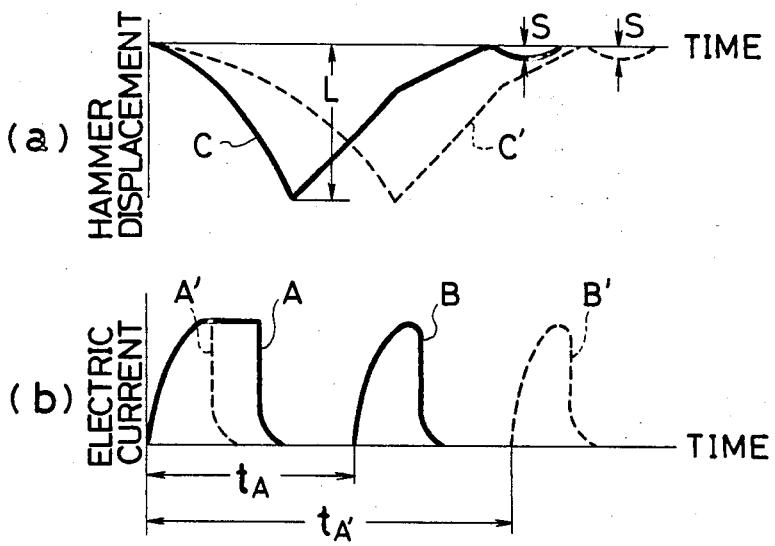
FIGS. 4(*a*) and (*b*) are graphs showing the performance of one embodiment of the present invention in which FIG. 4(*a*) shows the displacement of the hammer as a function of time when the current waveform shown in FIG. 4(*b*) is applied.

FIGS. 4(*a*) and (*b*) illustrate the performance of the first embodiment where the timing of applying reenergization is varied in accordance with the intensity or pulse width of the primary energization current pulse with maintaining the intensity or pulse width of the reenergization current pulse unchanged. That is, as shown in FIG. 4(*b*), the secondary energization current pulse B is applied after time period $t_A$ as from the initiation of primary energization current pulse A which has a larger pulse width; on the other hand, the secondary energization current pulse B′ is applied after time period $t_A$, as from the initiation of primary energization current pulse A′ which has a smaller pulse width. It is to be noted that the current pulses B and B′ are the same, but time period $t_A$, is longer than time period $t_A$.

FIG. 4(*a*) illustrates the hammer displacement as a function of time when the current pulses shown in FIG. 4(*b*) are applied. The curve C shown in FIG. 4(*a*)is the case when the pulses A and B are applied; whereas, the curve C′ is the case when the pulses A′ and B′ are applied. As shown, the level of hammer rebound S is kept minimum even if the intensity of the primary energization is changed since the timing of application of reenergization is appropriately controlled. It should be noted that the amount of rebound is dependent upon heat and friction as well as intensity of the primary energization, and, thus, the conditions of secondary energization must be determined in consideration of these factors.

Figure 5:
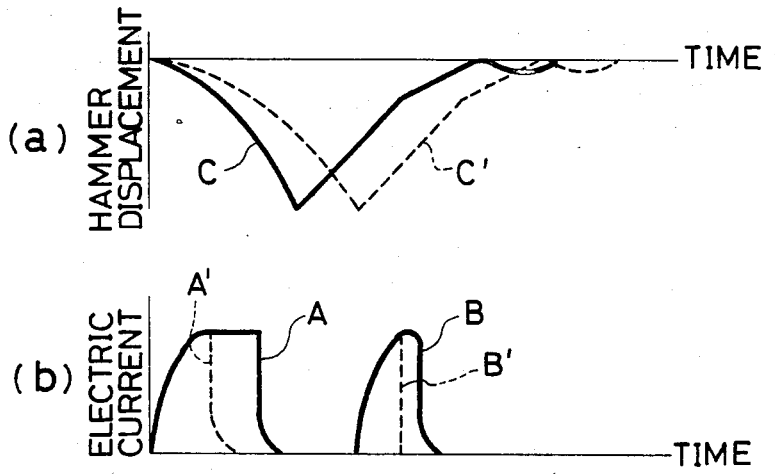
FIGS. 5(*a*) and (*b*) are graphs showing the performance of another embodiment of the present invention in which FIG. 5(*a*) shows the displacement of the hammer as a function of time when the current waveform shown in FIG. 5(*b*) is applied.

FIGS. 5(*a*) and (*b*) illustrate the performance of the second embodiment where the intensity or pulse width of reenergization is varied in accordance with the intensity or pulse width of the primary energization in maintaining the timing of applying the reenergization unchanged. Explaining more in detail, as shown in FIG. 5(*b*), either of the secondary energization current pulses B and B′ is applied with the same timing with respect to the start point of the primary energization current pulse A or A′. However, for primary current pulse A having a larger pulse width, secondary energization current pulse B has a larger pulse width; on the other hand, secondary energization current pulse B′ for primary current pulse A′ having a smaller pulse width has a correspondingly smaller pulse width.

FIG. 5(*a*) illustrates time-dependent hammer displacement curves when the current pulses shown in FIG. 5(*b*) are applied. The curve C is the case when the pulses A and B are applied; whereas, the curve C′ is the case when the pulses A′ and B′ are applied. In accordance with this second embodiment, the level of hammer rebound is kept extremely small even if the striking force of the hammer is changed. It is to be noted that this second embodiment is particularly effective for the case in which the range of changes in intensity of the primary energization is relatively narrow and the point in time of initiating the returning motion of the hammer does not change significantly.

Figure 6:
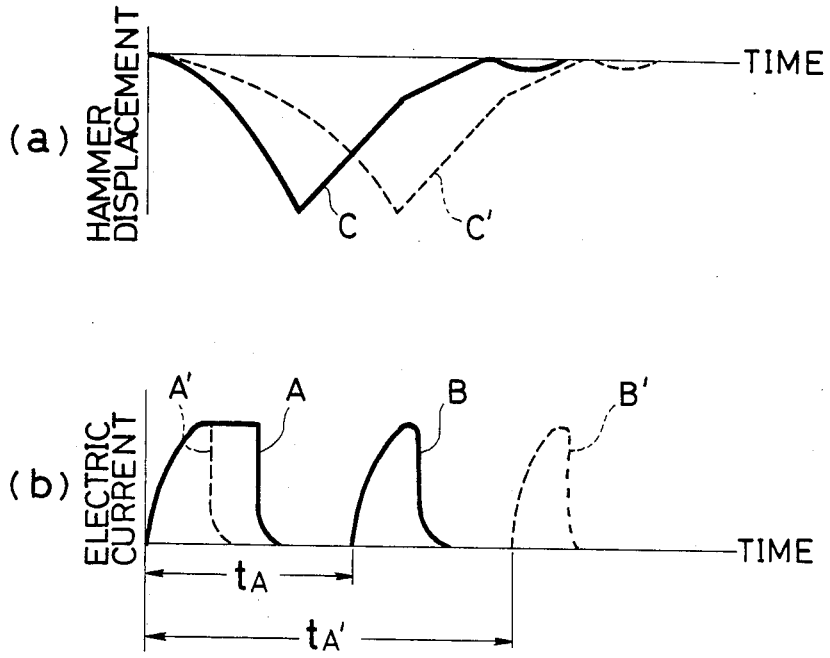
FIGS. 6(*a*) and (*b*) are graphs showing the performance of a further embodiment of the present invention in which FIG. 6(*a*) shows the displacement of the hammer as a function of time when the current waveform shown in FIG. 6(*b*) is applied.

FIGS. 6(*a*) and (*b*) illustrate the performance of the third embodiment in which both of the intensity and timing of application of secondary energization are varied in accordance with the intensity of primary energization. As described above, this is a combination of the first and second embodiments. As shown in FIG. 6(*b*), for a large primary energization by current pulse A, secondary energization is carried out by current pulse B which is applied with timing $t_A$. On the other hand, for a small primary energization by current pulse A′, use is made of current pulse B′, which has a smaller pulse width as compared with current pulse B and which is applied with timing $t_{A'}$, in order to carry out secondary energization.

FIG. 6(*a*) shows the hammer displacement curve as a function of time when the current pulses shown in FIG. 6(*b*) are applied. That is, the curve C is the case when the pulses A and B are applied and the curve C′ is the case when the pulses A′ and B′ are applied. As shown, the level of hammer rebound is also maintained very small at all times irrespective of changes in intensity of primary energization.

According to the present inventor's experiments, the following results have been obtained. Given the plunger type printing hammer in which the maximum displacement L of the hammer 5 is 4.5 mm, and the reciprocating time of the hammer 5 is 7 msec. for a large primary energization (pulse width=1.7 msec.) and 9.5 msec. for a small primary energization (pulse width=1.2 msec.). In the case of the large primary energization, the amount S of rebound was 1.2 mm without application of secondary energization. On the other hand, the rebound amount S was diminished to 0.3 mm by applying secondary energization with timing $t_A$=3.5 msec. and pulse width=0.6 msec.

In the case of the small primary energization (pulse width=1.2 msec.), the rebound amount was 0.5 mm without application of secondary energization. However, it was decreased to 0.2 mm by applying secondary energization with timing $t_{A'}$=5.1 msec. and pulse width=0.4 msec. It should also be noted that decrease in rebound amount also indicates decrease in production of impact noise. Thus, an apparently small decrease in rebound amount, in fact, brings about significant overall improvements.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A printing hammer rebound control system for use in an impact type printing machine including a slidably supported hammer which has a core section and an impact surface for impacting a selected one of type elements, a coil disposed in operative association with said core section and biasing means for biasing said hammer in a predetermined direction, said rebound control system comprising:

means for applying a primary energization signal to said coil to move said hammer in the forward direction to apply an impact force to said selected one of type elements, said primary energization signal being provided from stored primary energization data so as to be variable in intensity depending upon the type element selected for at least some of said type elements;

means for applying a secondary energization signal after termination of said primary energization signal to said coil to apply a force to said hammer in said forward direction when said hammer is approaching its original position during its returning motion, said secondary energization signal being provided from secondary energization data previously determined varyingly in accordance with the intensity of said primary energization signal and being the same in intensity but variable in timing of application in accordance with the intensity of said primary energization signal;

storing means for separately storing said primary and secondary energization data; and means for generating said primary and secondary energization signals separately;

thereby maintaining the amount of rebound of said hammer at a minimum even if the intensity of said primary energization signal varies.

2. A system of claim 1, wherein said storing means includes a semiconductor memory.

3. A system of claim 2, wherein said semiconductor memory is a read-only memory.

4. A system of claim 1, wherein said primary energization data is stored in said storing means in the form of codes each indicating the width of a current pulse to be applied to said coil.

5. A system of claim 1, wherein said impact type printing machine further includes a damper disposed to be engageable with said hammer when said hammer is located at its original position.

6. A system of claim 5, wherein said biasing means includes a spring which normally presses said hammer against said damper to keep said hammer at its original position.

7. A printing hammer rebound control system for use in an impact type printing machine including a slidably supported hammer which has a core section and an impact surface for impacting a selected one of type elements, a coil disposed in operative association with said core section and biasing means for biasing said hammer in a predetermined direction, said rebound control system comprising:

means for applying a primary energization signal to said coil to move said hammer in the forward direction to apply an impact force to said selected one of type elements, said primary energization signal being provided from stored primary energization data so as to be variable in intensity depending upon the type element selected for at least some of said type elements;

means for applying a secondary energization signal after termination of said primary energization signal to said coil to apply a force to said hammer in said forward direction when said hammer is approaching its original position during its returning motion, said secondary energization signal being provided from secondary energization data previously determined varyingly in accordance with the intensity of said primary energization signal and being the same in timing of application but variable in intensity in accordance with the intensity of said primary energization signal;

storing means for separately storing said primary and secondary energization data; and means for generating said primary and secondary energization signals separately;

thereby maintaining the amount of rebound of said hammer at a minimum even if the intensity of said primary energization signal varies.

8. A system of claim 7, wherein said storing means includes a semiconductor memory.

9. A system of claim 8, wherein said semiconductor memory is a read-only memory.

10. A system of claim 7, wherein said primary energization data is stored in said storing means in the form of codes each indicating the width of a current pulse to be applied to said coil.

11. A system of claim 7, wherein said impact printing machine further includes a damper disposed to be engageable with said hammer when said hammer is located at its original position.

12. A system of claim 11, wherein said biasing means includes a spring which normally presses said hammer against said damper to keep said hammer at its original position.

13. A printing hammer rebound control system for use in an impact type printing machine including a slidably supported hammer which has a core section and an impact surface for impacting a selected one of type elements, a coil disposed in operative association with said core section and biasing means for biasing said hammer in a predetermined direction, said rebound control system comprising:

means for applying a primary energization signal to said coil to move said hammer in the forward direction to apply an impact force to said selected one of type elements, said primary energization signal being provided from stored primary energization data so as to be variable in intensity depending upon the type element selected for at least some of said type elements;

means for applying a secondary energization signal after termination of said primary energization signal to said coil to apply a force to said hammer in said forward direction when said hammer is approaching its orginal position during its returning motion, said secondary energization signal being provided from secondary energization data previously determined varyingly in accordance with the intensity of said primary energization signal and being variable both in intensity and in timing of application in accordance with the intensity of said primary energization signal;

storing means for separately storing said primary and secondary energization data; and means for generating said primary and secondary energization signals separately;

thereby maintaining the amount of rebound of said hammer at a minimum even if the intensity of said primary energization signal varies.

14. A system of claim 13, wherein said storing means includes a semiconductor memory.

15. A system of claim 14, wherein said semiconductor memory is a read-only memory.

16. A system of claim 13, wherein said primary energization data is stored in said storing means in the form of codes each indicating the width of a current pulse to be applied to said coil.

17. A system of claim 13, wherein said impact type printing machine further includes a damper disposed to be engageable with said hammer when said hammer is located at its original position.

18. A system of claim 17, wherein said biasing means includes a spring which normally presses said hammer against said damper to keep said hammer at its orginal position.

* * * * *